US005825237A

United States Patent [19]

Ogawa

[11] Patent Number: 5,825,237

[45] Date of Patent: Oct. 20, 1998

[54] REFERENCE VOLTAGE GENERATION CIRCUIT

[75] Inventor: Yukitaka Ogawa, Chiba, Japan

[73] Assignee: Seiko Instruments Inc., Japan

[21] Appl. No.: 730,300

[22] Filed: Oct. 11, 1996

[30] Foreign Application Priority Data

Oct. 13, 1995 [JP] Japan ..... 7-265796

[51] Int. Cl.[6] ..... G05F 1/10; G05F 3/02

[52] U.S. Cl. ..... 327/545; 327/546; 327/538; 327/543; 327/540; 327/541

[58] Field of Search ..... 327/143, 198, 327/538, 539, 540, 541, 542, 543, 545–546

[56] References Cited

U.S. PATENT DOCUMENTS

| | | | |
|---|---|---|---|
| 4,634,905 | 1/1987 | Campbell, Jr. | 307/594 |
| 5,243,231 | 9/1993 | Baik | 307/296.3 |
| 5,287,011 | 2/1994 | Koshikawa et al. | 307/272.3 |
| 5,467,052 | 11/1995 | Tsukada | 327/543 |
| 5,565,811 | 10/1996 | Park et al. | 327/546 |

*Primary Examiner*—Timothy P. Callahan
*Assistant Examiner*—An T. Luu
*Attorney, Agent, or Firm*—Adams & Wilks

[57] ABSTRACT

The object of the present invention is to provide a reference voltage generation circuit which is arranged to obtain the stability of a reference voltage Vref both at the time of start of the power source voltage and at the time of fluctuation of the power source voltage for the reference voltage generation circuit that generates a high reference voltage (Vref). When closing the power source, a low level signal and a high level signal are output from a power source start circuit. These signals are received by a started circuit to thereby make all transistors therein "on" and thereby output a stable reference voltage Vref. The starting characteristic is improved compared to that of a conventional reference voltage generation circuit, whereby the starting has become possible to attain. Even when the power source voltage sharply fluctuates, a stable reference voltage Vref can be output. It has become possible to make compatible the outputting of a high reference voltage Vref and the stability of the reference voltage Vref at the time of sharp fluctuation of the power source voltage.

10 Claims, 2 Drawing Sheets

REFERENCE VOLTAGE GENERATION CIRCUIT

BACKGROUND OF THE INVENTION

The present invention relates to a reference voltage generation circuit.

A reference voltage generation circuit is composed of a power source start circuit and a started circuit.

The power source start circuit is one which is intended to start the started circuit at a power source closing time. The term started circuit which is referred to herein is a general term that represents various circuits each of which necessitates the performance of a prescribed starting operation at the time when the power source rises. For example, there is a reference voltage generation circuit.

FIG. 2 is a circuit diagram illustrating a conventional power source start circuit and a started circuit that is started thereby.

In this figure, a reference numeral 10 represents a power source start circuit and a circuit that is to be started thereby is a started circuit 20. As an example of the started circuit 20, there is illustrated a reference voltage generation circuit. This reference voltage generation circuit has an output portion 4 to thereby generate a constant voltage output signal (Vref). The constant voltage output is referred to hereinafter as "Vref". The started circuit is not limited to this form of circuit.

In the conventional reference voltage generation circuit, at the power source closing time, the power source start circuit C11 is at ground potential GND. The starting method therefor is such that an electric current is caused to flow into a transistor P21 until the potential increases gradually from the ground potential to become a threshold voltage or less thereof, the electric current is also caused to flow into a transistor P22 that consists of a current mirror, and thereafter the electric current is caused to flow into transistors N21 and N22 to thereby cause the start of the started circuit (reference voltage circuit).

In the above-mentioned conventional example, it is difficult to make compatible the generation of a high constant voltage Vref and the achievement of the stability thereof at the power source closing time.

For example, in an ordinary case, as the Vref there is outputted only a voltage that is somewhat higher than the threshold voltage of the N channel MOSFET N22. When attempting to generate a high Vref, it is necessary to increase the channel length L of all transistors of the started circuit 20 and thereby modify each of them in such a manner as to restrict the electric current. However, due to this modification, there is sometimes a case where at the power source closing time the started circuit is not started. In operation, as described in the conventional technique, in the case where the time length during which the start-up circuit C11 has a potential higher than the threshold voltage of the P channel MOSFET P21 is short, it becomes impossible to cause the flow thereinto of a sufficient amount of current. It is necessary to increase the time length for causing the flow of the current by an amount sufficient to compensate for the extent to which the current has been restricted. In order to start the started circuit, the capacitance C11 of the power source start circuit 10 is increased to thereby increase the time length during which the start circuit C11 has a potential higher than the threshold voltage of the P channel MOSFET P21. This enables the improvement of the starting characteristic. However, when the power source voltage sharply drops, since the electric charge that is accumulated in the capacitor C11 is not released, the P channel MOSFETs P21 and P22 of the started circuit 20 go "off", with the result that the Vref is brought from the constant voltage outputting state to an unstable state.

SUMMARY OF THE INVENTION

The object of the present invention is to make possible the generation of a high level Vref and the achievement of stability in the Vref regardless of sharp fluctuations in the power source voltage, the achievement of which was problematic in the conventional technique.

The present invention employs the following means to achieve the foregoing object.

(1) A reference voltage generation circuit that is composed of a reference voltage circuit and a power source start circuit for starting the reference voltage circuit at the time of closure of a power source, wherein the reference voltage circuit comprises a first complementary insulated gate field effect transistor circuit having at least two starting input terminals, and the power source start circuit is comprises a second complementary insulated gate field effect transistor circuit that includes a first starting output terminal having ground potential level at the power source closing time and a second starting output terminal having a level that is approximate to that of the power source voltage.

(2) A reference voltage generation circuit as described under the first item, which is characterized in that a first circuit which is formed by a connection between a drain terminal of a first conductivity type first insulated gate field effect transistor and a drain terminal of a second conductivity type second insulated gate field effect transistor and a second circuit which is formed by a connection between a drain terminal of a first conductivity type third insulated gate field effect transistor and a drain terminal of a second conductivity type fourth insulated gate field effect transistor, the first and second circuits being connected in parallel with each other with respect to the power source voltage, and the respective gate electrodes of the first and the third insulated gate field effect transistor being connected to the drain terminal of the first insulated gate field effect transistor to thereby constitute the starting input terminal and the respective gate electrodes of the second and the fourth insulated gate field effect transistor being connected to the drain terminal of the fourth insulated gate field effect transistor to thereby constitute the other starting input terminal and constant voltage output terminal.

(3) A reference voltage generation circuit as described under the first item, which further comprises a capacitor and a resistor functional element that are connected in series with each other between the power source voltage and a ground power source terminal, a first inverter circuit whose input is constituted by the potential at a point of connection between the capacitor and the resistor functional element, a second inverter circuit whose input is constituted by the output potential of the first inverter circuit, a second conductivity type fifth insulated gate field effect transistor whose gate electrode is driven by the output potential of the first inverter circuit and which is provided between a ground power source terminal and the first starting input terminal and a first conductivity type sixth insulated gate field effect transistor whose gate electrode is driven by the output potential of the second inverter circuit and which is provided between the power source terminal and the second starting output terminal.

DETAILED DESCRIPTION OF THE PREFERRED EMBODIMENTS

Figure 1:
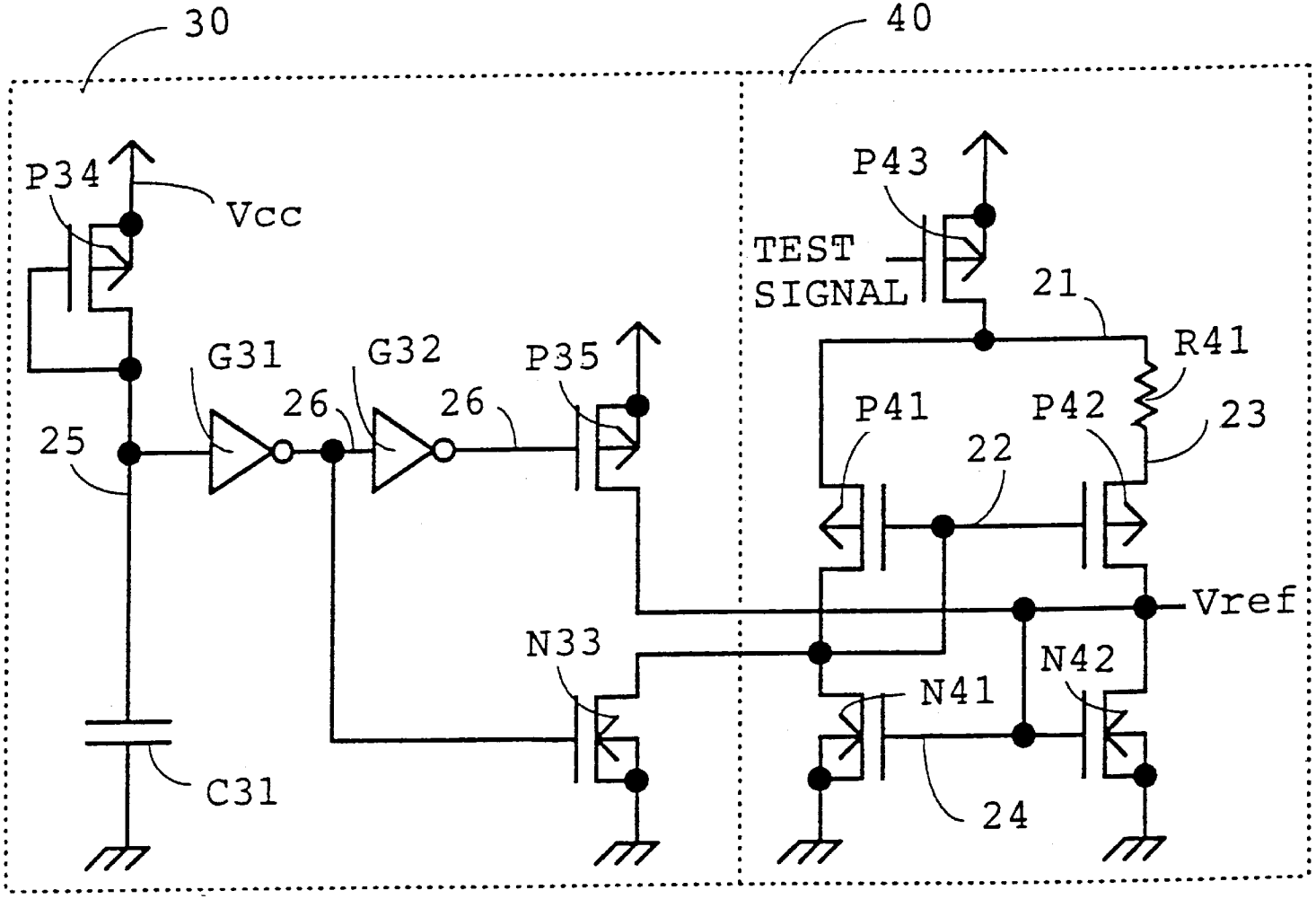
FIG. 1 is a circuit diagram illustrating an embodiment of the present invention.
Figure 2:
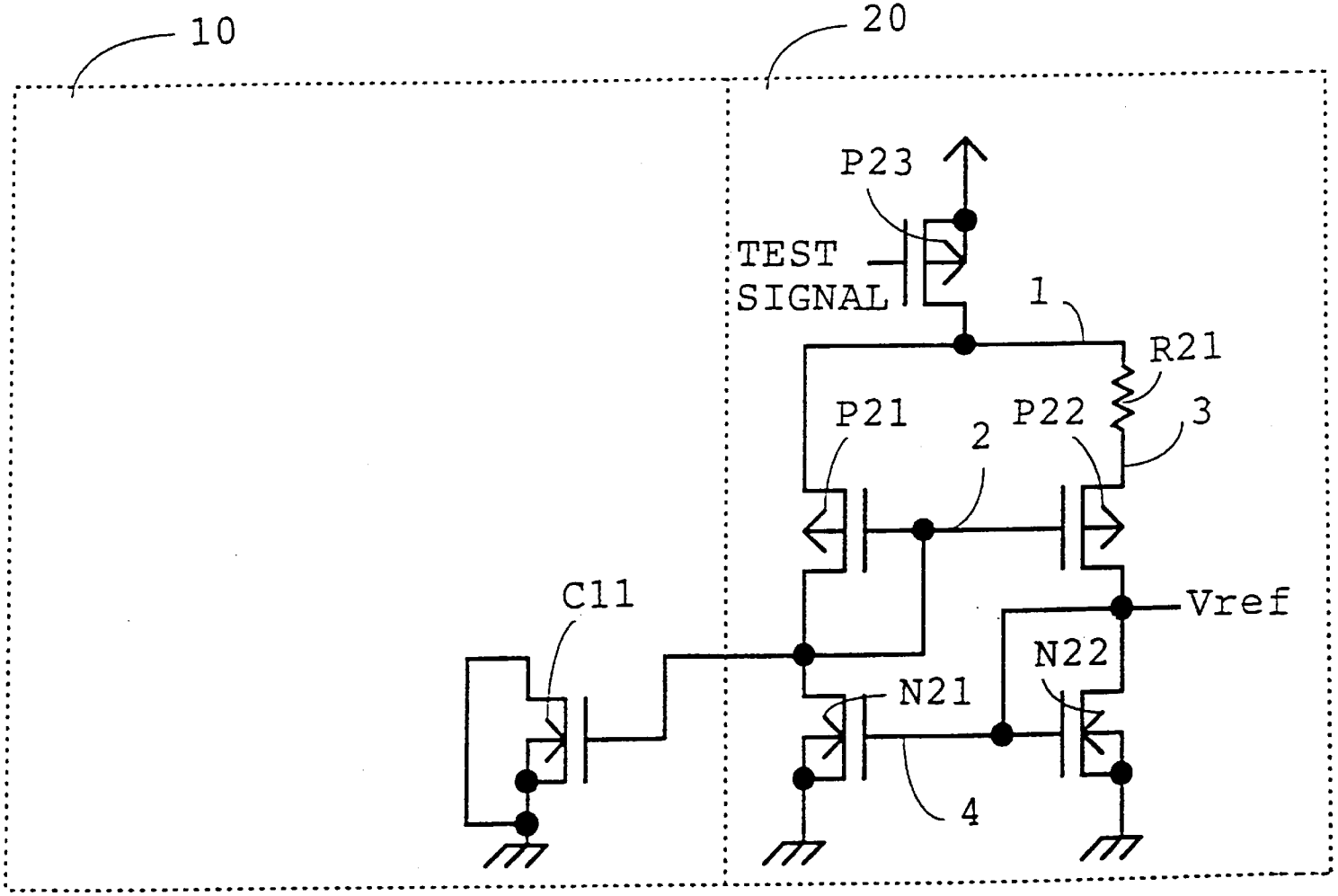
FIG. 2 prior art
FIG. 2 is a circuit diagram illustrating an example of a reference voltage generation circuit that was developed prior to the achievement of the present invention.

FIG. 1 is a circuit diagram illustrating an embodiment of the present invention. Respective circuit elements illustrated in this circuit diagram are preferably formed on a semiconductor substrate such as that which consists of a single crystal silicon although no particular limitation is made thereto, and are formed using a known manufacturing technique for manufacturing a CMOS (Complementary MOS) integrated circuit.

Although not particularly limited thereto, the integrated circuit of this embodiment is formed on a semiconductor substrate such as that which consists of a single crystal P-type silicon. A P-type channel MOSFET P41 for example is composed of a source region and drain region which are formed in a surface of an N-type well region formed in the semiconductor substrate and a gate electrode consisting of polysilicon which is formed on the surface of the semiconductor substrate between the source region and drain region through a gate insulation film.

An N channel MOSFET N41 for example is formed in the surface of the semiconductor substrate. As a result of this construction, the N-type well region constitutes a substrate gate of the P channel MOSFET that has been formed thereon. The P-type substrate constitutes a substrate gate of the N channel MOSFET that has been formed thereon. The substrate gate of the N channel MOSFET, i.e., the P-type substrate, is connected to a power source terminal VSS. Also, the substrate gate of the P channel MOSFET, i.e., the N-type well region, is connected to VCC potential or the source region of the P channel MOSFET.

An explanation will now be given of the connection of a started circuit 40. In this embodiment, reference is made to the case where the started circuit 40 is a reference voltage generation circuit. The drain of a P channel MOSFET P43 is connected to the source of a P channel MOSFET P42 and to one side of a resistor R41. The other side of the resistor R41 is connected to the source of a P channel MOSFET, P42. The gate and drain of the P channel MOSFET P41 are connected to the gate of the P channel MOSFET P42, and further to the drain of an N channel MOSFET N41 and the drain of an N channel MOSFET N33 of a power source start circuit 30. The drain of the P channel MOSFET P42 is connected to the gate and drain of an N channel MOSFET N42 and to the drain of a P channel MOSFET P35 of the power source start circuit 30. One or both of output lines 22 and 24 are used as output lines for outputting a reference voltage Vref. The P channel MOSFET P43 is used at the time of, for example, switch sampling test. For example, the current consumption is suppressed by operating this circuit during a certain period of time and keeping it out of operation during the remaining period of time. The P channel MOSFET P43 may be omitted in the present invention. The resistor R41 is not only for the purpose of controlling the current consumption but also for the purpose of changing the reference voltage in level.

An explanation will now be given of the connection of the power source start circuit 30. The gate and drain of the P channel MOSFET P34 are connected to a capacitor C31 and the input of a CMOS inverter G31 while, on the other hand, the output of the CMOS inverter G31 is connected to the input of a CMOS inverter G32 and the gate of the N channel MOSFET N33. The drain of the N channel MOSFET N33 is connected to the started circuit 40 as mentioned above. The output of the CMOS inverter G32 is connected to the gate of a P channel MOSFET P35, the drain of which is connected to the started circuit 40 as mentioned above.

The operation of the above-mentioned power source start circuit and the like will now be explained. The input level of the CMOS inverter G31 is lowered from the power source voltage VCC by an amount the extent which corresponds to the threshold voltage of the P channel MOSFET P34, which results in the input level thereof becoming lower than the logic threshold voltage of the CMOS inverter G31 at the time of closure of the power source. As a result of this, the output signal of the CMOS inverter G31 becomes high in level and therefore the N channel MOSFET N33 is turned "on" while, on the other hand, the output of the CMOS inverter G32 becomes low in level and therefore the P channel MOSFET P35 is turned "on". As mentioned above, at the time of closure of the power source, the high level signal and low level signal are output from the power source start circuit 30. As a result of this, the P channel MOSFETs P41 and P42 and N channel MOSFETs N41 and N42 are all turned "on" almost simultaneously, whereby the started circuit 40 is started. Thereafter, when the power source voltage increases in level and as a result the input of the CMOS inverter G31 becomes higher in level than the logic threshold voltage thereof, the output signal of the CMOS inverter G31 becomes low in level with the result that the N channel MOSFET N33 is turned "off" and the output of the CMOS inverter G32 becomes high in level with the result that the P channel MOSFET is turned "off". The outputs of the P channel MOSFET P35 and the N channel MOSFET N33 are each placed in a floating state with the result that the power source start circuit 30 has no effect on the started circuit 40. As a result of this, the started circuit 40 continues outputting a constant voltage. In the above-mentioned circuit, unlike the conventional example, at the time of a sharp change in the power source voltage and the P channel MOSFETs P41 and P42 are stopped from turning "off" by no charge being released because no starting capacitors are connected to the gates thereof, the output reference voltage Vref does not become unstable.

As explained above, according to the present invention, the start characteristic of the reference voltage generation circuit has been improved compared to that of the conventional reference voltage generation circuit.

Since at the starting time all transistors of the started circuit are turned "on" almost simultaneously, it has become possible for the starting to be executed reliably.

The degree of freedom for the design of the started circuit (reference voltage circuit) is also increased.

Even when the power source voltage sharply fluctuates, it is possible to output a stable reference voltage Vref.

As mentioned above, it has become possible to make compatible the outputting of a high reference voltage Vref and the stability of the reference voltage Vref at the time when the fluctuation of the power source voltage is sharp.

The present invention can be widely employed as a reference voltage generation circuit in the semiconductor integrated circuit that includes a circuit requiring the use of the reference voltage generation circuit such as a constant voltage circuit and voltage detection circuit.

What is claimed is:

1. A reference voltage generation circuit comprising:

a reference voltage circuit for receiving a power source voltage and producing a constant reference voltage, the reference voltage circuit comprising a first complementary insulated gate field effect transistor circuit having at least two starting input terminals; and a power source start circuit for starting up the reference voltage circuit upon application of the power source voltage, the power source start circuit comprising a second complementary insulated gate field effect transistor circuit including a first starting output terminal having approximately a ground potential level and a second starting output terminal having a voltage level which is approximate to that of the power source voltage at the time of the initial application of the power source voltage;

wherein the first complementary insulated gate field effect transistor circuit comprises a first insulated gate field effect transistor having a first conductivity type, a second insulated gate field effect transistor having a second conductivity type, a third insulated gate field effect transistor having the first conductivity type and a fourth insulated gate field effect transistor having the second conductivity type, wherein a circuit comprising a connection between a drain terminal of the first insulated gate field effect transistor and a drain terminal of the second insulated gate field effect transistor and another circuit comprising a connection between a drain terminal of the third insulated gate field effect transistor and a drain terminal of the fourth insulated gate field effect transistor are connected in parallel to each other with respect to the power source voltage, and the respective gate electrodes of the first and the third insulated gate field effect transistors are connected to the drain terminal of the first insulated gate field effect transistor to thereby constitute a first starting input terminal and the respective gate electrodes of the second and the fourth insulated gate field effect transistors are connected to the drain terminal of the fourth insulated gate field effect transistor to thereby constitute a second starting input terminal, and wherein one of the first and second starting input terminals serves as an output terminal for outputting the constant reference voltage.

2. A reference voltage generation circuit according to claim 1; wherein the second complementary insulated gate field effect transistor circuit comprises a capacitor and a resistive element connected in series with each other and disposed between the power source voltage and a ground terminal, a first inverter circuit having an input terminal connected between the capacitor and the resistive element, a second inverter circuit having an input terminal connected to an output terminal of the first inverter circuit, a first insulated gate field effect transistor having the second conductivity type and having a gate electrode driven by the output of the first inverter circuit, the first insulated gate field effect transistor of the second complementary insulated gate field effect transistor circuit being connected between a ground terminal and the first starting output terminal, and a second insulated gate field effect transistor having a first conductivity type and having a gate electrode driven by an output of the second inverter, the second insulated gate field effect transistor of the second complementary insulated gate field effect transistor circuit being connected between the power source terminal and the second starting output terminal.

3. A reference voltage generation circuit comprising:

a reference voltage circuit for receiving a power source voltage and producing a constant reference voltage, the reference voltage circuit comprising a first complementary insulated gate field effect transistor circuit having at least two starting input terminals; and a power source start circuit for starting up the reference voltage circuit upon application of the power source voltage, the power source start circuit comprising a second complementary insulated gate field effect transistor circuit including a first starting output terminal having approximately a ground potential level and a second starting output terminal having a voltage level which is approximate to that of the power source voltage at the time of application of the power source voltage; wherein the second complementary insulated gate field effect transistor circuit comprises a capacitor and a resistive element connected in series with each other and disposed between the power source voltage and a ground terminal, a first inverter circuit having an input terminal connected between the capacitor and the resistive element, a second inverter circuit having an input terminal connected to an output terminal of the first inverter circuit, a first insulated gate field effect transistor having a second conductivity type and having a gate electrode driven by the output of the first inverter circuit, the first insulated gate field effect transistor being connected between a ground terminal and the first starting output terminal, and a second insulated gate field effect transistor having a first conductivity type and having a gate electrode driven by an output of the second inverter, the second insulated gate field effect transistor being connected between the power source terminal and the second starting output terminal.

4. A reference voltage generation circuit according to claim 3; wherein the first complementary insulated gate field effect transistor circuit comprises a first insulated gate field effect transistor having the first conductivity type, a second insulated gate field effect transistor having the second conductivity type, a third insulated gate field effect transistor having the first conductivity type and a fourth insulated gate field effect transistor having the second conductivity type, wherein a circuit comprising a connection between a drain terminal of the first and second insulated gate field effect transistors of the first complementary insulated gate field effect transistor circuit and another circuit comprising a connection between drain terminals of the third and fourth insulated gate field effect transistors of the first complementary insulated gate field effect transistor circuit are connected in parallel to each other with respect to the power source voltage, and the respective gate electrodes of the first and third insulated gate field effect transistors of the first complementary insulated gate field effect transistor circuit are connected to the drain terminal of the first insulated gate field effect transistor of the first complementary insulated gate field effect transistor circuit to thereby constitute a first starting input terminal and the respective gate electrodes of the second and fourth insulated gate field effect transistors of the first insulated gate field effect transistor circuit are connected to the drain terminal of the fourth insulated gate field effect transistor to thereby constitute a second starting input terminal, and wherein one of the first and second starting input terminals serves as an output terminal for the constant reference voltage.

5. A reference voltage generation circuit comprising:

a reference voltage circuit for receiving a power source voltage and producing a constant reference voltage, the reference voltage circuit comprising a first complementary insulated gate field effect transistor circuit having at least two starting input terminals; and a power source start circuit for receiving the power source voltage and starting up the reference voltage circuit upon initial application of the power source voltage, the power source start circuit comprising a second complementary insulated gate field effect transistor circuit comprising a first starting output terminal having approximately a ground level potential and a second starting output terminal having a voltage level which is approximately that of the power source voltage at the time of the initial application of the power source voltage;

wherein the second complementary insulated gate field effect transistor circuit comprises a first circuit including a capacitor and a resistive element connected in series with each other between the power source voltage and a ground terminal, a second circuit responsive to the potential at a point of connection between the capacitor and the resistive element for making the level of the first starting output terminal approximately that of ground potential, and a third circuit responsive to the potential at a point of connection between the capacitor and the resistive functional element for making the voltage level of the second starting output terminal approximately that of the power source voltage.

6. A reference voltage generation circuit according to claim 5; wherein the first complementary insulated gate field effect transistor circuit comprises a first insulated gate field effect transistor having a first conductivity type, a second insulated gate field effect transistor having a second conductivity type, a third insulated gate field effect transistor having the first conductivity type and a fourth insulated gate field effect transistor having the second conductivity type, wherein a circuit comprising a connection between a drain terminal of the first insulated gate field effect transistor and a drain terminal of the second insulated gate field effect transistor and another circuit comprising a connection between a drain terminal of the third insulated gate field effect transistor and a drain terminal of the fourth insulated gate field effect transistor are connected in parallel with each other with respect to the power source voltage, the respective gate electrodes of the first and the third insulated gate field effect transistor are connected to the drain terminal of the first insulated gate field effect transistor to thereby constitute a first starting input terminal and the respective gate electrodes of the second and the fourth insulated gate field effect transistors are connected to the drain terminal of the fourth insulated gate field effect transistor to thereby constitute a second starting input terminal, and one of the starting input terminals serving also as a constant voltage output terminal.

7. A reference voltage generation circuit comprising:

a reference voltage circuit for receiving a power source voltage and producing a constant reference voltage, the reference voltage circuit having two starting input terminals; and a start circuit for receiving the source voltage, starting up the reference voltage circuit via the two starting input terminals upon initial application of the source voltage, wherein the start circuit comprises a capacitor and a resistive element connected in series with each other and disposed between the source voltage and ground, a first inverter circuit having an input terminal connected between the capacitor and the resistive element, a second inverter circuit having an input terminal connected to an output terminal of the first inverter circuit, a first insulated gate field effect transistor having a gate electrode connected to the output of the first inverter circuit and which is connected between a ground terminal and a first starting input terminal, and a second insulated gate field effect transistor having a gate electrode connected to an output of the second inverter and which is disposed between the power source terminal and a second starting input terminal.

8. A reference voltage generation circuit according to claim 7; wherein the first complementary insulated gate field effect transistor circuit comprises a first insulated gate field effect transistor having a first conductivity type, a second insulated gate field effect transistor having a second conductivity type, a third insulated gate field effect transistor having the first conductivity type and a fourth insulated gate field effect transistor having the second conductivity type, wherein a circuit comprising a connection between drain terminals of the first and second insulated gate field effect transistors of the first complementary insulated gate field effect transistor circuit and another circuit comprising a connection between drain terminals of the third and fourth insulated gate field effect transistors of the first complementary insulated gate field effect transistor circuit are connected in parallel with each other with respect to the power source voltage, and the respective gate electrodes of the first and the third insulated gate field effect transistors of the first complementary insulated gate field effect transistor circuit are connected to the drain terminal of the first insulated gate field effect transistor of the first complementary insulated gate field effect transistor circuit to thereby constitute a first starting input terminal and the respective gate electrodes of the second and the fourth insulated gate field effect transistors of the first complementary insulated gate field effect transistor circuit are connected to the drain terminal of the fourth insulated gate field effect transistor to thereby constitute a second starting input terminal and a constant voltage output terminal.

9. A start circuit for use with a started circuit which receives a power source voltage from a power source for starting the started circuit, the start circuit comprising: a capacitor and a resistor connected in series with each other and disposed between the source voltage and ground, a first inverter circuit having an input terminal connected between the capacitor and the resistor, a second inverter circuit having an input terminal connected to an output terminal of the first inverter circuit, a first insulated gate field effect transistor having a gate electrode driven by the output of the first inverter circuit and which is connected between a grounded power source terminal and a first starting input terminal, and a second insulated gate field effect transistor having a gate electrode driven by an output of the second inverter and which is disposed between the power source terminal and a second starting input terminal.

10. A reference voltage generation circuit comprising:

a reference voltage circuit for receiving a source voltage and generating a constant reference voltage; and a start circuit for receiving the source voltage and starting up the reference voltage circuit upon initial application of the source voltage thereto;

wherein the start circuit comprises a pair of series-connected inverters and a transistor connected to each inverter for generating a start signal for starting the reference voltage circuit upon initial application of the source voltage, and a charge storage element connected to an input of one of the inverters for inverting the output thereof upon build up of a sufficient charge.

* * * * *